US006321761B1

(12) United States Patent
Brenkus et al.

(10) Patent No.: US 6,321,761 B1
(45) Date of Patent: Nov. 27, 2001

(54) APPARATUS FOR HOLDING DOWN BOTTLES IN A HIGH PRESSURE WASH

(75) Inventors: Frank M. Brenkus, Morgan Hill; Craig B. Garrett, San Jose, both of CA (US)

(73) Assignee: Portola Packaging, Inc., San Jose, CA (US)

( * ) Notice: Subject to any disclaimer, the term of this patent is extended or adjusted under 35 U.S.C. 154(b) by 0 days.

(21) Appl. No.: 09/447,841

(22) Filed: Nov. 23, 1999

Related U.S. Application Data

(62) Division of application No. 09/222,252, filed on Dec. 28, 1998, now Pat. No. 6,009,889.

(51) Int. Cl.[7] ..... B08B 9/00

(52) U.S. Cl. ..... 134/170; 134/166 R; 134/169 R

(58) Field of Search ..... 134/166 R, 169 R, 134/170, 171, 199, 198, 167 R, 168 R; 239/264, 574

(56) References Cited

U.S. PATENT DOCUMENTS 910,882 * 1/1909 Truesdale .
1,114,066 * 10/1914 Templeton .
1,577,236 * 3/1926 Huss ..... 134/167 R
1,824,993 * 9/1931 Herold et al. ..... 134/167 R
2,140,589 * 12/1938 Lannmark .
2,599,455 * 6/1952 Huseman .
2,633,437 * 3/1953 Detjen .
2,655,929 * 10/1953 Herold .
3,262,460 * 7/1966 Huddle et al. .
3,291,143 * 12/1966 Huddle .
3,838,473 * 10/1974 Remith .
5,073,182 * 12/1991 Virey et al. .
5,348,033 * 9/1994 Levit .
5,373,618 * 12/1994 Doyle et al. .
5,598,859 * 2/1997 Kronseder .
5,885,401 * 3/1999 Eiban .
6,003,529 * 12/1999 Perrt, Jr. .

* cited by examiner

*Primary Examiner*—Frankie L. Stinson
(74) *Attorney, Agent, or Firm*—Flehr Hohbach Test Albritton & Herbert LLP

(57) ABSTRACT

A machine for washing bottles has a conveyor which advances intermittently from station to station. The conveyor has a carriage extending transversely thereof formed to receive at least one inverted bottle. Full cone spray nozzles located above and below the bottles as they pass along the conveyor spray warmed detergent solution on the exteriors of the bottles at each station. High pressure or solid stream jet nozzles at each stage project a jet of water from below into the inverted open mouth of each bottle at the stage to thoroughly clean the interior of each bottle. To counterbalance the forces of the jets below, which tend to lift the bottles off the conveyor, a jet of fluid from above impacts the inverted bottom of each bottle.

13 Claims, 4 Drawing Sheets

APPARATUS FOR HOLDING DOWN BOTTLES IN A HIGH PRESSURE WASH

This is a division of application Ser. No. 09/222,252 filed Dec. 28, 1998 now U.S. Pat. No. 6,009,889.

BACKGROUND OF THE INVENTION

1. Field of the Invention

This invention relates to a now and improved apparatus for washing bottles. More particularly, the invention relates to washing bottles returned to a bottling works for refilling wherein while traversing a main washing station, a jet of water directed to wash the inside of the inverted bottle tends to overcome the weight of the bottle and move the bottle off its carrier. In accordance with the present invention a counterbalancing jet of water is directed from the top toward the bottom of the inverted bottle to maintain the bottle on the conveyor.

2. Description of Related Art

Large containers such as 6 gallon, 5 gallon or 3 gallon and metric equivalent water bottles, preparatory to filling are washed, sanitized and rinsed. At multiple stations, the exteriors of the containers are sprayed with warmed cleaning solution while a pressure jet of the same solution is directed through the open neck of the inverted container into the interior. With increasing lighter weights of containers, including the shift from glass to plastic and to smaller containers, there has been a corresponding shift to lower impact pressures and flow rate, to prevent containers from being lifted off the conveyor. Although the lower impact and flow result in a reduced likelihood that containers will be lifted off the conveyor, they also reduce the effectiveness of the washing. Additionally, new containers with complex features such as handles are being introduced to the market, which make the current low impact and flow less effective. Mechanical clamps of various types have been unreliable and costly in solving the problem because of wide variations in the size, shoulder profile, neck profile and height of the containers.

The present invention differs from prior apparatus and methods for retaining the containers on the conveyor by directing a downward fluid on the inverted bottom of the container which counterbalances the upward force of the upward jet which is directed through the open neck of the container.

SUMMARY OF THE INVENTION

Although this invention may be used for other purposes, the following description will be limited to use in cleaning bottles. Preparatory to filling, returned empty bottles are passed through a washing process consisting of several stages. The apparatus involves use of a conveyor which is moved, preferably intermittently, through a loading stage where the bottles are loaded onto a conveyor either manually or mechanically. In the main wash stage, wash detergent solution heated by electric heaters or steam coils or by an external solution heater is pumped through nozzles. Multiple nozzles direct the spray outside each bottle. At each stage there is an upwardly directed jet of solution which passes through the neck of the bottle and cleans the interior. It has been found that the combination of high impact and flow rate creates a force which tends to overcome the weight of the bottle, causing it to lift off the conveyor. There are usually several wash stages within the main wash station.

At the next station a recirculated rinse is directed within the bottle and on the outsides thereof. Typically, the pressure at the rinse stage is not as great as the pressure at the main wash stage and hence a hold-down nozzle may not be necessary at the rinse stage. From the rinse stage the bottles pass to a sanitizing stage where ozonated water, chlorinated water or commercial sanitizing agents are used to sanitize the inside of the bottle. Following the sanitizing stage there is a final rinse stage where clean water is used inside the bottle to remove all residual materials, leaving the bottle completely clean and sanitized and ready for filling.

The present invention is an improvement over prior washing systems in that at the main wash stage a jet of fluid is directed downwardly against the inverted bottom of each bottle to counterbalance the upward force of the jet inserting water into the interior of the bottle and thereby preventing the bottle from being lifted off the holder. A similar downward jet may be used at other stages, as may be required.

BRIEF DESCRIPTION OF THE DRAWINGS

The accompanying drawings, which are incorporated in and form a part of this specification, illustrate embodiments of the invention and, together with the description serve to explain the principles of the invention.

DETAILED DESCRIPTION OF THE PREFERRED EMBODIMENT

Figure 1:
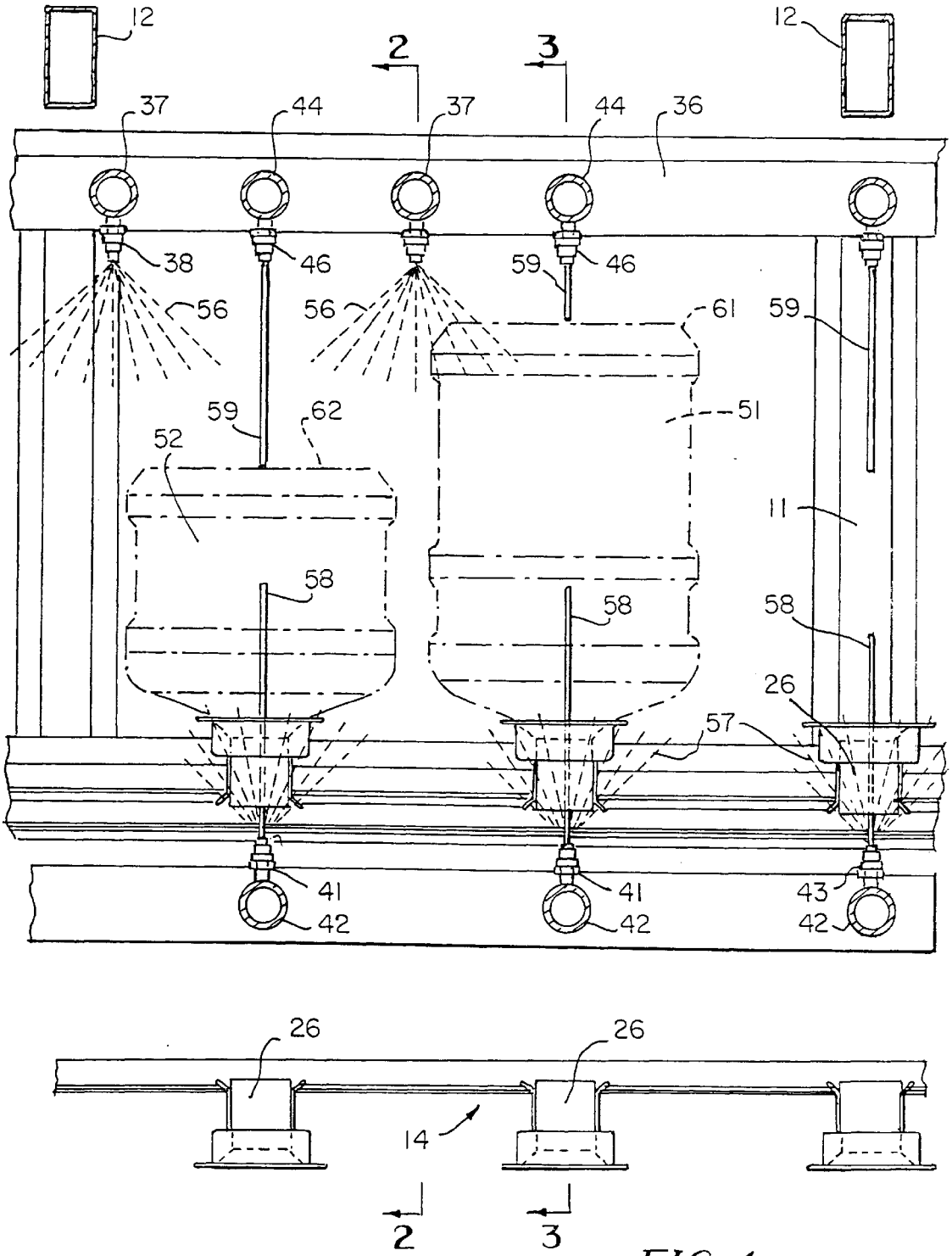
FIG. 1 is a schematic side elevational view of a portion of a main wash stage of a bottle cleaning operation.

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

A preferred use of the present invention is to clean empty bottles such as a 5 gallon bottle 51 or a 3 gallon bottle 52. Each such bottle has a top shoulder 53 from which extends an open and narrow neck 54. Bottle 51 has bottom 61 and bottle 52 has a bottom 62. It will be understood that other containers and other articles may be cleaned or otherwise treated.

The apparatus is mounted on a frame consisting of vertical members 11, horizontal cross members 12 and horizontal longitudinal members 13, the construction of which is subject to wide variation. Preferably the front and back of the frame is mostly closed off with sides (not shown) which prevent the water within the system from spilling out into the room. Below the frame 11 is a tank (not shown) which collects the water after it has been sprayed on the bottles 51, 52. A pump (also not shown) pumps water out of the tank and into the apparatus hereinafter described.

Figure 6:
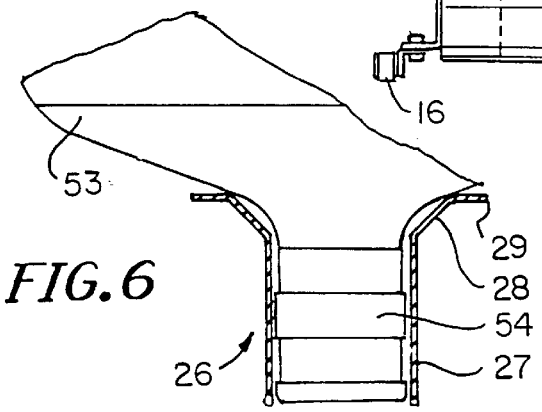
FIG. 6 is a further enlarged view of a holder which is mounted on the carrier (not shown) showing the neck of a bottle inserted therein.

On either side of the frame are chain drives 16 of any well-known type. Extending transversely of the chains 16 is a plurality of carriages 17. Each such carriage 17 has an end 18 from which depends and extends outwardly an ear 19 which is connected to a lug 20 on chain 16. Vertical sides 21 extend transversely of the direction of movement of chains 16. Mounted and affixed to surface 22 are holders 26 which are shaped to receive the necks 54 of bottles 51, 52. Thus each holder 26 has a cylindrical portion 27 in which the neck 54 fits. Above cylindrical portion 27 is a conical or outwardly-upwardly flared portion 28. A horizontally outwardly directed portion 29 is positioned at the top of the conical portion 28. As best shown in FIG. 6, the inverted bottle 51 or 52 is positioned so that its neck 54 is within the cylindrical portion 27 and that its shoulder 53 engages either the flange 29 or the conical portion 28.

Figure 2:
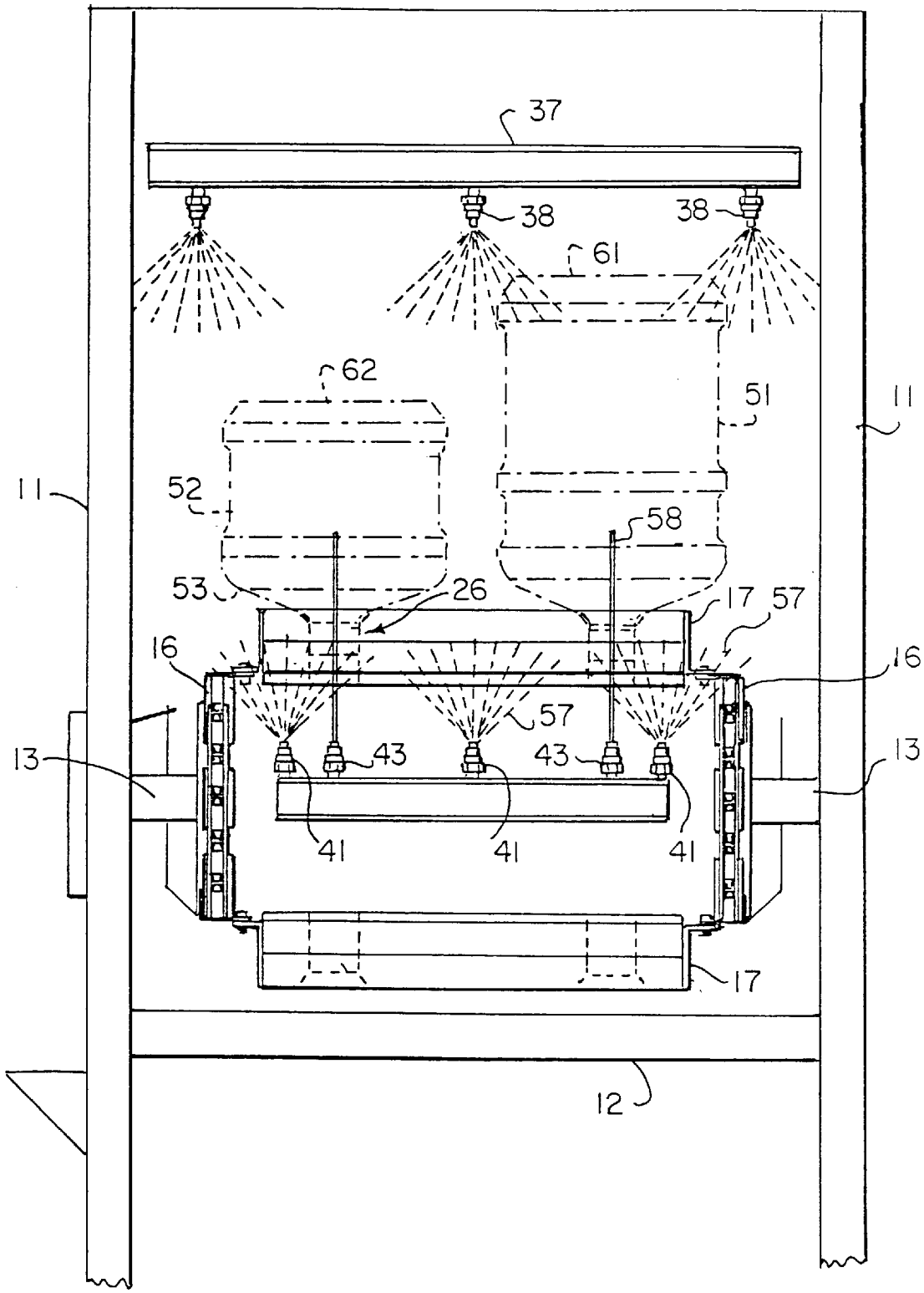
FIG. 2 is a sectional view taken substantially along the line 2—2 of FIG. 1, with certain items omitted for clarity.
Figure 3:
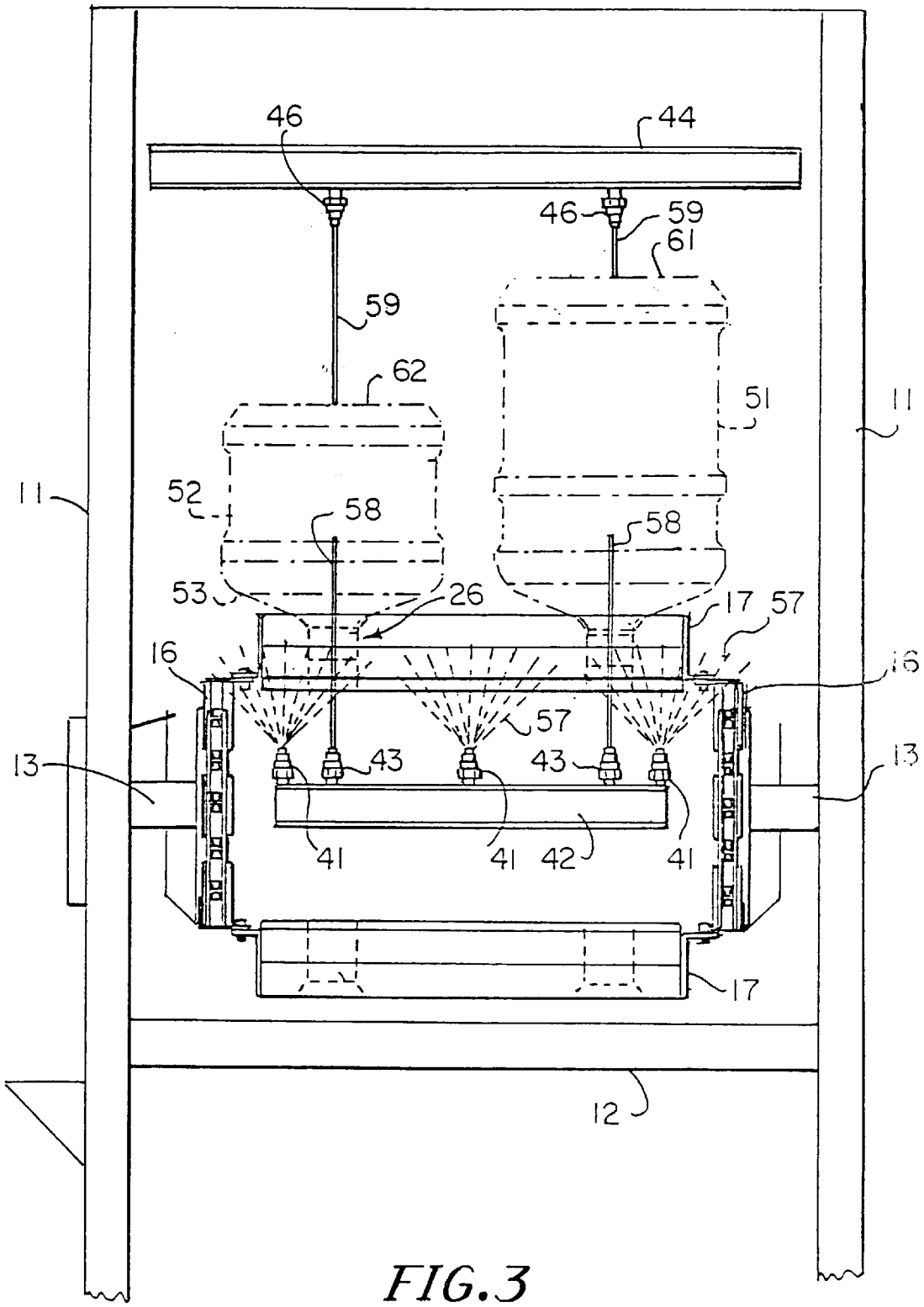
FIG. 3 is a sectional view taken substantially along the line 3—3 of FIG. 1, with certain items omitted for clarity.
Figure 4:
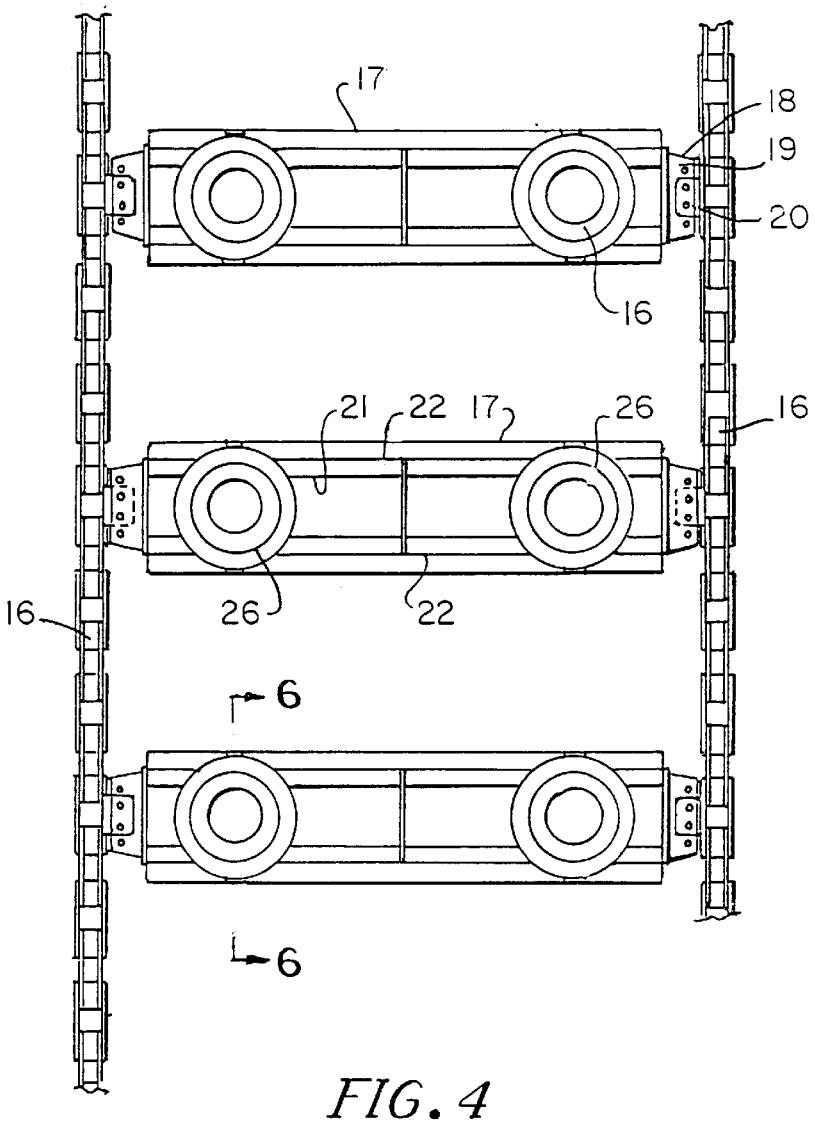
FIG. 4 is an enlarged fragmentary top plan view of a conveyor used to move bottles through the apparatus.
Figure 5:
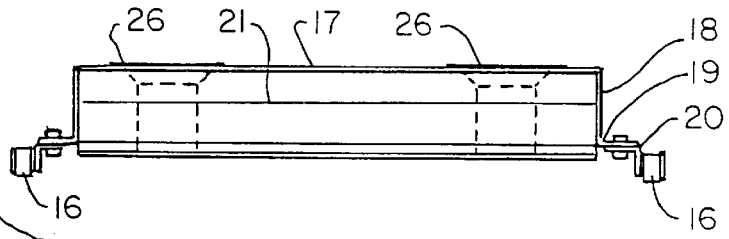
FIG. 5 is an end elevation of one of the carriages of the conveyor.

FIGS. 1–3 show only a portion of the main wash station of the bottle cleaning system. The chain drives 16 move from right to left as viewed in FIG. 1 and preferably move intermittently so that each carriage 17 stops in specific positions during progress of the bottle 51 or 52 from one end to the other. It will be understood that, although there are two bottles shown in side-by-side position in FIGS. 2 and 3, the number of such bottles may be reduced to one or increased to a considerable number such as ten, depending on the size of the equipment needed to satisfy the requirements of the bottling works.

Top and bottom longitudinal headers 36 receive the recycled main washing solution from the collection tank (not shown), pressurized by the pump (not shown). At the top of the system are transverse top spray pipes 37, preferably one between each position. Inserted at appropriate locations in pipe 37 are fall cone spray nozzles 38 which spray the outsides of bottles 51 or 52 for the purpose of cleaning as they stop at each position. At the bottom of the machine are transverse bottom pipes 42 into which are mounted at appropriate intervals full cone spray nozzles 41 similar to nozzles 38 to spray bottle exteriors.

Also mounted in pipes 42 between nozzles 41 and in a position directly under the holders 26 when they stop at a particular position are solid stream bottom jet nozzles 43 also connected to pipes 42 which direct jets 58 into the open necks of the bottles and clean the bottles by impinging upon the bottoms thereof and running down the sides and shoulders to thoroughly wash any contaminant or debris which may be in the bottles. Pressure ranges for pipe 42 heretofore have been from 20–35 psi for 5 gallon bottles and for 3 gallon bottles. The use of such bottom jet nozzles 43 is common in bottle cleaning apparatus heretofore in the prior art. With the increasing search for lighter weight bottles 51, 52 and the demand for higher pressure in the jet nozzles 43, there has been a tendency for the bottles 51, 52 to lift out of the holders 26. Mechanical clamp-down devices have not been satisfactory. Among the reasons for the failure of such clamps is the fact that a cleaning line may at different times handle bottles 51, 52 of different capacities. Further, the bottle varies in details of construction so that the height of the bottom 61, 62 of the bottle from the holders 26 varies and the profile of the neck 54 varies in details of construction making it difficult to grip with the holder 26.

In order to overcome the tendencies of bottles to be lifted off the conveyor holder 26, in accordance with the present invention top transverse pipes 44 are located above pipes 42. Solid stream top jet nozzles 46 are installed in pipes 44 above the nozzles 43. Pipes 44 may receive the same or a different fluid than pipes 42 and may be at the same or different pressures. A smaller orifice and flow rate can be used on the top jet nozzles 46 as compared with nozzles 43. Pipes 42 may then be at higher pressures than heretofore, such as 40–80 psi, or more and at a nozzle flow rate of 3 to 7 gallons per minute.

Thus as the bottles pass along the conveyor chains 16 through the main wash area they are at several positions within the main wash station subjected to external top sprays 56 and bottom sprays 57. The purpose for these sprays 56 is to clean the exterior of the bottle, and not to hold down the bottles. In addition, the interior of the bottle is cleaned by bottom jet sprays 58 which are directed through the open necks at the bottom of the bottle. Top jets 59 from nozzles 46 are directed against the bottoms 61, 62 to counteract the force of the jets 58 which tend to lift the bottles off the conveyor. Top jets 59 are directed transversely to bottoms 61, 62 and have a cross-sectional area of impingement less than the surface area of the bottoms 61, 62.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. Apparatus comprising, a holder to support a container having all open first end and a closed second end, with said second end above said first end, a first pipe for a first fluid under pressure beneath said first end, a first orifice communicating with said first pipe positioned to direct a first stream of first fluid up through said first end to clean the interior of said container, a second pipe above said second end for a second fluid under pressure, a second orifice communicating with said second pipe to direct a second stream of said second fluid against said second end to counterbalance the force of said first stream tending to lift said container from said holder, and a third orifice communicating with said first pipe positioned to direct a spray of said first fluid to clean the exterior of said container adjacent said open first end.

2. Apparatus according to claim 1 in which said first orifice is located in a first nozzle connected to said first pipe and said third orifice is located in a third nozzle connected to said first pie.

3. Apparatus according to claim 1 in which said second orifice is in a second nozzle connected to said second pipe.

4. Apparatus according to claim 1 in which said container is a bottle and said first end includes a neck and said second end is a bottom, said third orifice positioned to direct a spray of first fluid to clean the exterior of said bottle adjacent said neck.

5. Apparatus according to claim 4 in which said holder is formed to receive said neck and engage said bottle to hold said bottle upright.

6. Apparatus according to claim 4 which further comprises a carriage for said holder and at least one additional holder on said carriage to hold an additional bottle parallel to said first-mentioned bottle.

7. Apparatus according to claim 4 in which said first fluid is detergent solution.

8. Apparatus according to claim 4 which further comprises a plurality of third pipes having fourth nozzles to spray said first fluid on the exterior of said bottle.

9. Apparatus comprising, a conveyor having a stretch moving substantially longitudinally, a plurality of carriages on said conveyor extending substantially transversely, at least one holder on said carriage shaped to support a bottle in and inverted position, the bottle having an open neck at one end and a bottom opposite said one end, a first pipe below said carriage having a first nozzle shaped and positioned to direct a first stream of solution up through the neck to wash the interior of the bottle, a second pipe above the path of movement of bottles along said stretch, a second nozzle on said second pipe to direct a second stream of a second fluid under pressure against the bottom to counterbalance the force of said first stream tending to lift the bottle from said holder, and a third orifice communicating, with said first pipe positioned to direct a spray of said first fluid to clean the exterior of the container adjacent the open neck.

10. Apparatus according to claim 9 which further comprises aligned first and second pipes having aligned first and second nozzles to project streams of water into each said bottle as it proceeds along said stretch.

11. Apparatus according to claim 9 which further comprises means to advance said conveyor intermittently from position to position along said stretch, there being a first nozzle below and a second nozzle above said bottle at each said position.

12. Apparatus according to claim 11 in which each said carriage has a plurality of holders for a plurality of bottles, there being a plurality of first nozzles and a plurality of second nozzles at each said position for each of said plurality of bottles.

13. Apparatus according to claim 9 which further comprises a plurality of third pipes each having at least one spray type fourth nozzle to spray solution over the exteriors of said bottles adjacent the bottoms thereof.

* * * * *